US007576710B2

(12) United States Patent
Kim et al.

(10) Patent No.: US 7,576,710 B2
(45) Date of Patent: Aug. 18, 2009

(54) PLASMA DISPLAY PANEL AND DRIVING METHOD THEREOF

(75) Inventors: Jin-Sung Kim, Suwon-si (KR); Woo-Joon Chung, Suwon-si (KR); Seung-Hun Chae, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 820 days.

(21) Appl. No.: 10/969,346

(22) Filed: Oct. 19, 2004

(65) Prior Publication Data

US 2005/0088374 A1 Apr. 28, 2005

(30) Foreign Application Priority Data

Oct. 23, 2003 (KR) ..... 10-2003-0074299

(51) Int. Cl.
*G09G 3/28* (2006.01)

(52) U.S. Cl. ..... 345/60; 345/67; 345/68

(58) Field of Classification Search ..... 345/60, 345/67–68

See application file for complete search history.

(56) References Cited

U.S. PATENT DOCUMENTS 6,707,436 B2 3/2004 Setoguchi et al.
6,972,739 B2 * 12/2005 Kim ..... 345/60

FOREIGN PATENT DOCUMENTS

CN 1254153 A 5/2000
KR 2000-0006211 1/2000
KR 2002-0061500 7/2002

OTHER PUBLICATIONS

Korean Patent Abstracts for Publication No. 1020020061500; Date of publication of application Jul. 24, 2002, in the name of Seong Ho Kang.
Korean Patent Abstracts for Publication No. 1020000006211; Date of publication of application Jan. 25, 2000, in the name of Asaosigeharu et al.
English abstract for EP0965975, corresponding to CN 1254153 listed above.

* cited by examiner

*Primary Examiner*—Richard Hjerpe
*Assistant Examiner*—Leonid Shapiro
(74) *Attorney, Agent, or Firm*—Christie Parker & Hale LLP

(57) ABSTRACT

A method for dividing a frame into a plurality of subfields, and driving them on a plasma display panel having a plurality of first electrodes and second electrodes formed in parallel on a first substrate, and a plurality of third electrodes formed on a second substrate and extending over the first and second electrodes. A first voltage and a second voltage are applied to the first electrode and the second electrode of the discharge cell to be selected from among the discharge cells during an address period of a first subfield with the minimum weight from among the subfields, such that the difference between the first voltage and the second voltage is less than a discharge firing voltage.

17 Claims, 6 Drawing Sheets

PLASMA DISPLAY PANEL AND DRIVING METHOD THEREOF

CROSS REFERENCE TO RELATED APPLICATION

This application claims priority to and the benefit of Korea Patent Application No. 2003-74299 filed on Oct. 23, 2003 in the Korean Intellectual Property Office, the entire content of which is incorporated herein by reference.

BACKGROUND OF THE INVENTION (a) Field of the Invention

The present invention relates to a plasma display panel (PDP). More specifically, the present invention relates to a PDP for improving representation performance of low gray scales and a driving method thereof.

(b) Description of the Related Art

A PDP is a flat display for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP, and FIG. 2 schematically shows a PDP electrode arrangement.

As shown in FIG. 1, the PDP includes glass substrates 1 and 6 facing each other with a predetermined gap therebetween. Scan electrodes 4 and sustain electrodes 5 in pairs are formed in parallel on glass substrate 1, and scan electrodes 4 and sustain electrodes 5 are covered with dielectric layer 2 and protection film 3. A plurality of address electrodes 8 is formed on glass substrate 6, and address electrodes 8 are covered with insulator layer 7. Barrier ribs 9 are formed on insulator layer 7 between address electrodes 8. Phosphors 10 are formed on the surface of insulator layer 7 and between barrier ribs 9. Glass substrates 1 and 6 face each other with discharge spaces between glass substrates 1 and 6 so that scan electrodes 4 and sustain electrodes 5 can extend over address electrodes 8. Discharge space 11 between address electrode 8 and a crossing part of a pair of scan electrode 4 and sustain electrode 5 forms discharge cell 12, which is schematically indicated.

As shown in FIG. 2, the electrodes of the PDP have an n×m matrix format. The address electrodes $A_1$ to $A_m$ are arranged in the column direction, and n scan electrodes $Y_1$ to $Y_n$ and n sustain electrodes $X_1$ to $X_n$ are arranged in pairs in the row direction.

A subfield in the PDP driving method includes a reset period, an address period, a sustain period, and an erase period (waveforms within a subfield will be described for ease of description).

In the reset period, states of respective cells are reset so that address operations of the cells may be fluently performed. In the address period (or a scan period or a write period), cells that are turned on and turned off on the panel are selected, and wall charges are accumulated at the turned-on cells (addressed cells.) In the sustain period, a discharge for displaying actual images on the addressed cells is performed. In the erase period, the wall charges on the cells are reduced, and the sustain discharge is terminated.

FIG. 3 shows a conventional PDP driving waveform and a quantity of light emitted by a subfield. As shown in the conventional PDP driving method, a minimum unit of light, that is, light of the subfield with a weight of 1 is represented as the summation of the light generated from the cell selected during the address period, the light generated at the time of a sustain discharge during the sustain period, and the light (which is the initial part of the reset period and is ignorable) during the reset period of the second subfield. In other words, in the period of the first subfield, an address discharge (address light) is generated to form positive ions at the scan electrode in the address period. The voltage at the scan electrode Y is established to be higher than the voltage at the sustain electrode X to apply sustain discharge voltage Vs between the scan electrode Y and the sustain electrode X, thereby performing a sustain discharge (sustain light) in the sustain period.

Next, the minimum unit of light is represented through a reset operation of the reset period of the second subfield. In this instance, the light emitted in the reset period is slightly less, so it is ignorable. The light for representing the second subfield (the weight of 2) is represented through the address discharge (address light) and two sustain discharges (sustain discharge voltage Vs is applied in pairs to the sustain electrode and the scan electrode) in the sustain period.

Therefore, since the minimum unit of light in the conventional PDP driving method includes an address discharge (address light) and a sustain discharge (sustain light), it is restricted in realizing a lower brightness. Further, high Xe is currently used so as to increase emission efficiency, and the magnitude of the unit of light generated by a single sustain discharge is increased, and a much lower minimum unit of light is required to increase the representation performance of the low gray scales in this condition.

SUMMARY OF THE INVENTION

In accordance with the present invention a PDP and a driving method thereof is provided for improving representation performance of low gray scales by reducing a minimum unit of light.

In one aspect of the present invention, a PDP receives external image data and displays the data during a reset period, an address period, and a sustain period. The PDP includes a plasma panel having a plurality of address electrodes, scan electrodes, and sustain electrodes. A controller receives image signals, generates and outputs scan electrode driving signals, sustain electrode driving signals, and address electrode driving signals, and outputs the sustain electrode driving signals so that the potential of the sustain electrode may be less than a first voltage applied during the reset period by a predefined voltage during the address period of the subfield with the minimum weight. An address data driver applies a voltage corresponding to the address electrode driving signal to the address electrode. A sustain electrode driver applies a voltage corresponding to the sustain electrode driving signal to the sustain electrode. A scan electrode driver applies a voltage corresponding to the scan electrode driving signal to the scan electrode.

In another aspect of the present invention, a PDP includes a first substrate and a plurality of first electrodes and second electrodes formed in parallel on the first substrate. A second substrate facing the first substrate with a gap there between and a plurality of third electrodes being formed on the second substrate and crossing the first and second electrodes. A driving circuit supplies driving voltages to the first, second, and third electrodes so as to discharge the discharge cell formed by the adjacent first, second, and third electrodes. The driving circuit respectively applies a first voltage and a second voltage to the first electrode and the second electrode of the discharge cell to be selected during the address period of the subfield with the minimum weight. The difference between the first and second voltages is less than the discharge firing voltage.

In still another aspect of the present invention, a method for driving a PDP by using a plurality of subfields is provided. The PDP has a plurality of first electrodes and second electrodes formed in parallel on a first substrate. A plurality of third electrodes are formed on a second substrate and cross the first and second electrodes. Discharge cells are formed by the adjacent first, second, and third electrodes. A reset voltage is applied to the first electrode and the second electrode to erase a wall charge state of a previous sustain discharge, and the wall charges are set up so as to stably perform a subsequent address discharge. A first voltage and a second voltage are applied to the first electrode and the second electrode of the discharge cell to be selected from among the discharge cells, and first light is generated.

In still yet another aspect of the present invention, a method is provided for dividing a frame into a plurality of subfields, and driving them on a PDP having a plurality of first electrodes and second electrodes formed in parallel on a first substrate, and a plurality of third electrodes formed on a second substrate and crossing the first and second electrodes. A first voltage and a second voltage are applied to the first electrode and the second electrode of the discharge cell to be selected from among the discharge cells during an address period of a first subfield with the minimum weight from among the subfields. A difference between the first voltage and the second voltage is less than a discharge firing voltage.

DETAILED DESCRIPTION

Figure 4:
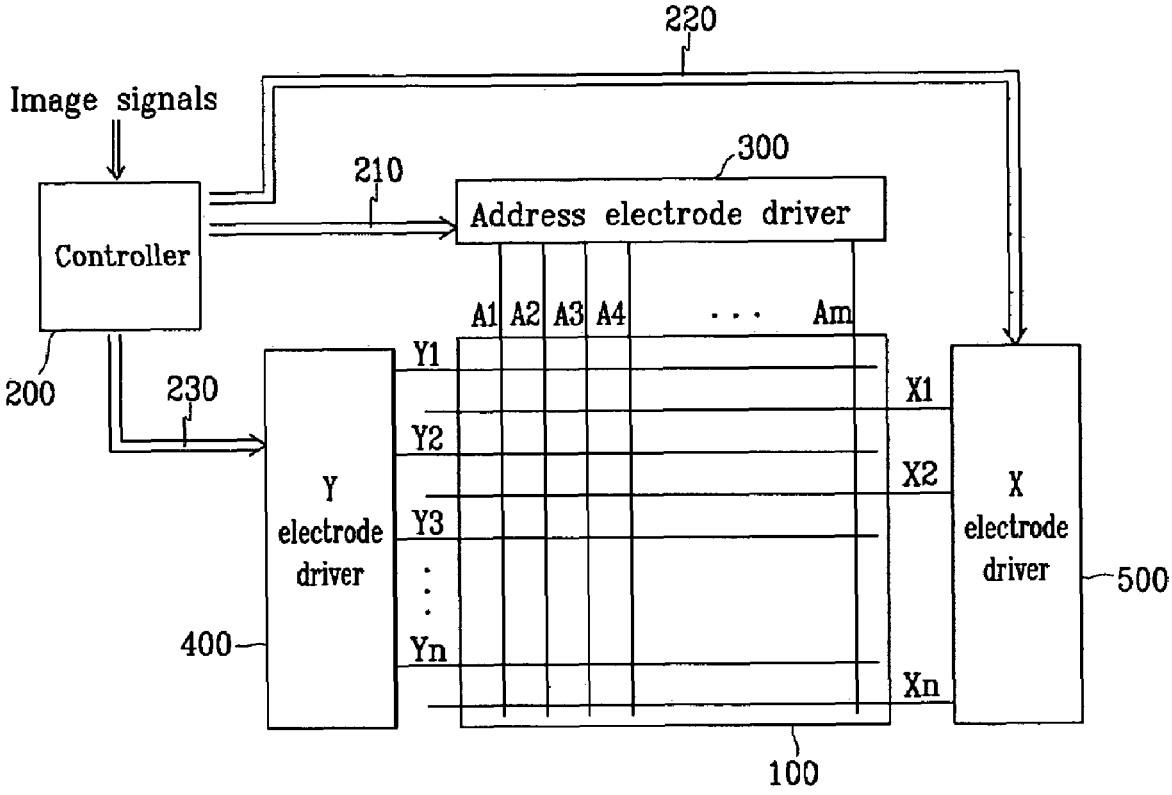
FIG. 4 shows a PDP configuration diagram according to a first exemplary embodiment of the present invention.

As shown in FIG. 4, the PDP includes plasma panel 100, controller 200, address electrode driver 300, scan electrode driver 400 (referred to as a Y electrode driver hereinafter), and sustain electrode driver 500 (referred to as an X electrode driver hereinafter).

Figure 1:
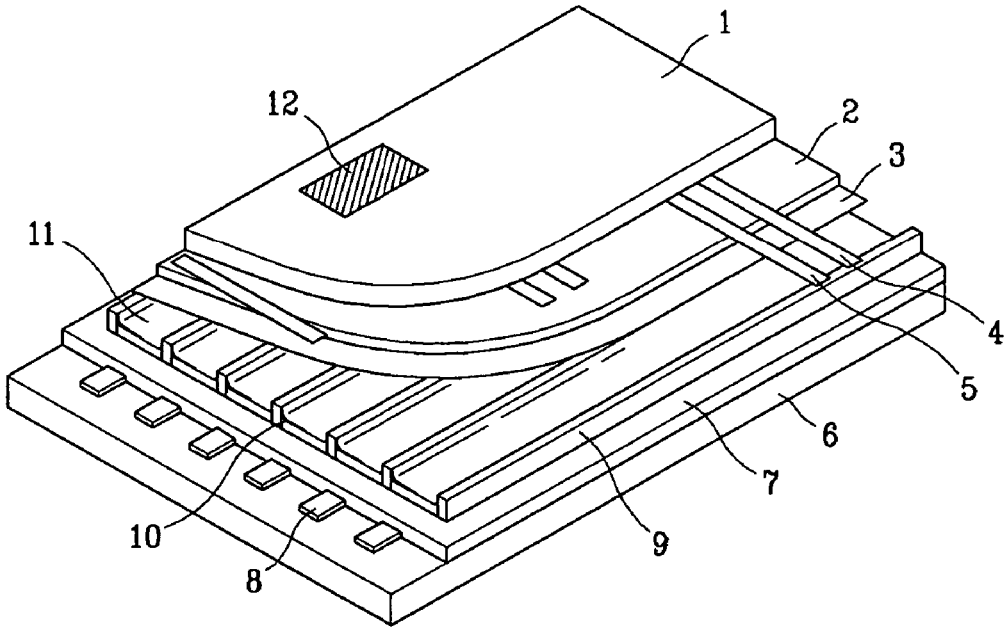
FIG.1(Prior Art)
FIG. 1 shows a partial perspective view of a general PDP.
Figure 2:
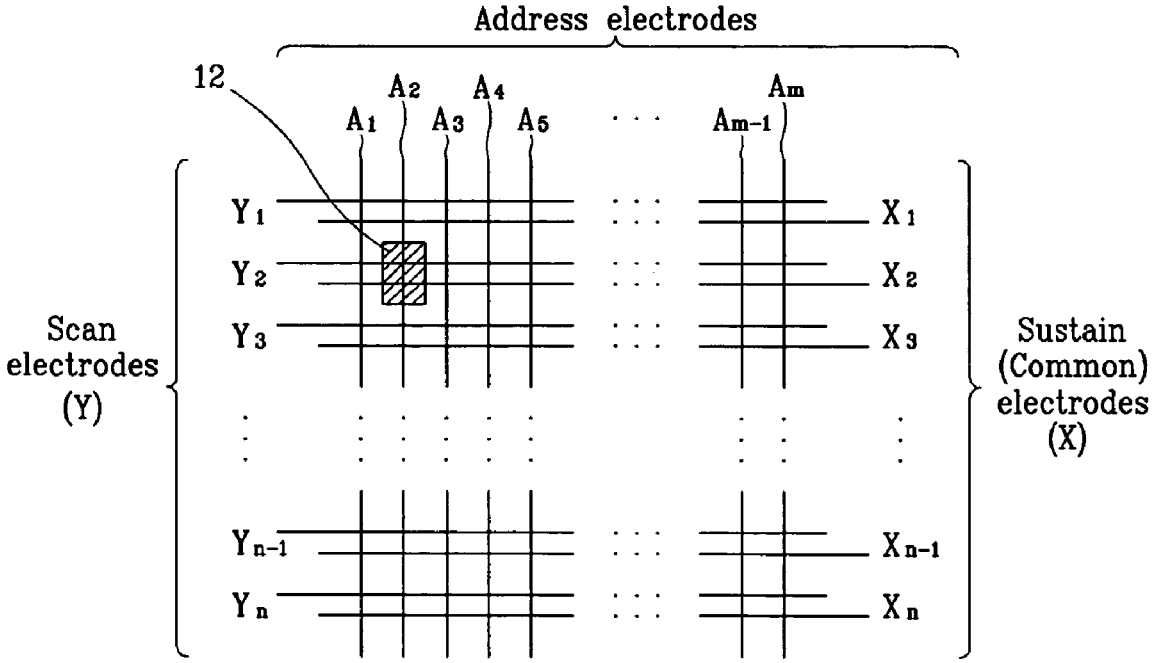
FIG.2(Prior Art)
FIG. 2 schematically shows a PDP electrode arrangement diagram.
Figure 3:
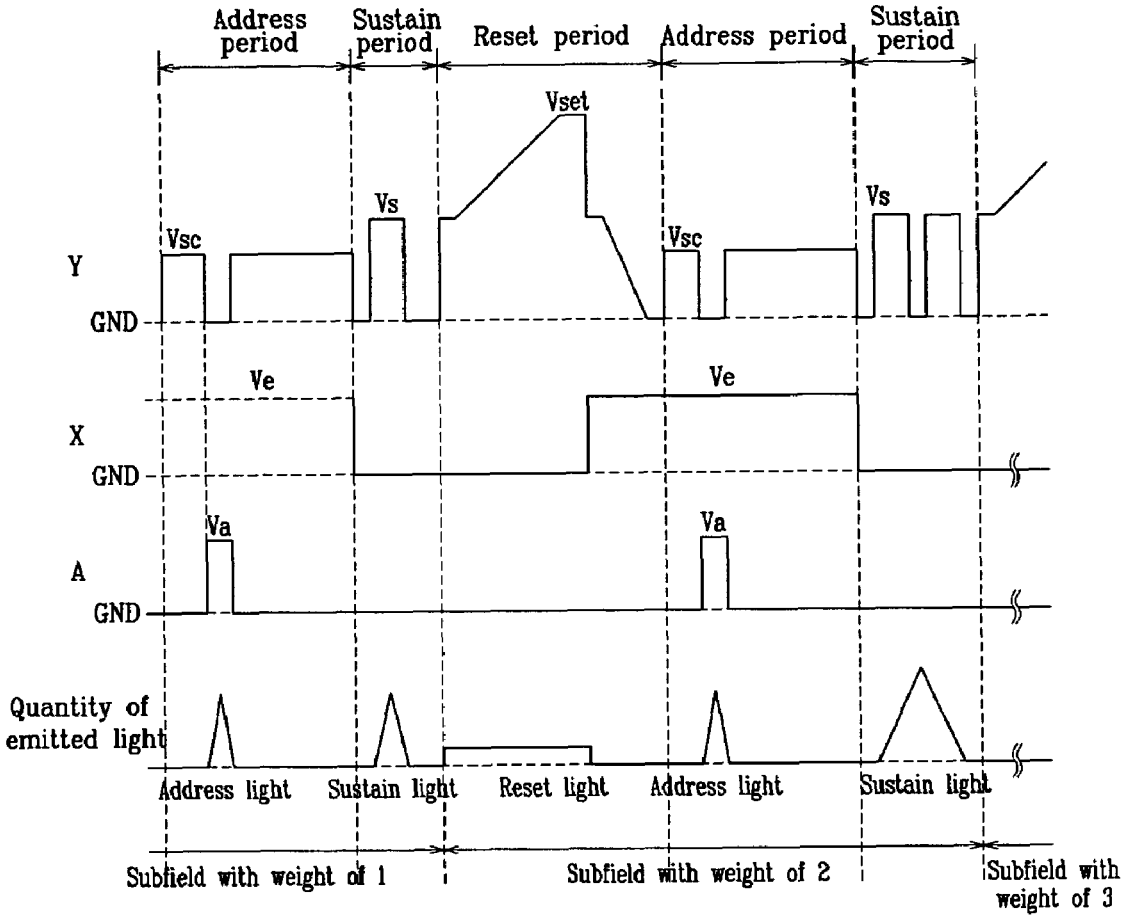
FIG.3(Prior Art)
FIG. 3 shows a conventional PDP driving waveform and a quantity of light emitted by a subfield.

Plasma panel 100 includes a plurality of address electrodes A1 through Am arranged in the column direction, a plurality of sustain electrodes (referred to as X electrodes hereinafter) X1 through Xn arranged in the row direction, and a plurality of scan electrodes (referred to as Y electrodes hereinafter) Y1 through Yn arranged in the row direction. The X electrodes X1 through Xn are formed corresponding to the respective Y electrodes Y1 through Yn, and their ends are coupled in common. Plasma panel 100 includes a glass substrate on which the X and Y electrodes X1 through Xn and Y1 through Yn are arranged, and a glass substrate on which the address electrodes A1 through Am are arranged similar to that shown in FIGS. 1 and 2. The two glass substrates face each other with a discharge space therebetween so that Y electrodes Y1 through Yn and X electrodes X1 through Xn may extend over address electrodes A1 through Am. In this instance, discharge spaces on the crossing points of address electrodes A1 through Am and the X and Y electrodes X1 through Xn and Y1 through Yn form discharge cells.

Controller 200 externally receives video (image) signals, and outputs address driving signals 210, X electrode driving signals 220, and Y electrode driving signals 230. Also, controller 200 divides a single frame into a plurality of subfields and drives them. Each subfield includes a reset period, an address period, and a sustain period with respect to temporal operation variations. In particular, controller 200 outputs Y electrode driving signal 230 so that the level of voltage applied to the X electrode during the address period of the subfield with the minimum weight may be less by a predetermined voltage than the voltage applied during the reset period.

Address driver 300 receives address driving signals from controller 200, and applies display data signals for selecting desired discharge cells to the respective address electrodes A1 through Am. X electrode driver 500 and Y electrode driver 400 receives X electrode driving signals 220 and Y electrode driving signals 230 from controller 200, and applies driving voltages to the X electrodes X1 through Xn, and Y electrode driver 400 receives Y electrode driving signals 230 from controller 200, and applies driving voltages to the Y electrodes Y1 through Yn.

A PDP operation will now be described in detail.

Controller 200 receives external image signals, corrects gamma according to PDP characteristics, divides the corrected image signals into N subfields, and outputs X electrode driving signals 220, Y electrode driving signals 230, and address electrode driving signals 210 for the respective subfields.

Address electrode driver 300 receives address electrode driving signals 210, and applies to the respective address electrodes A1 to Am display data signals for selecting discharge cells to be displayed.

X electrode driver 500 receives X electrode driving signals 220, and applies driving voltages to the X electrodes X1 to Xn. Y electrode driver 400 receives Y electrode driving signals 230, and applies driving voltages to the Y electrodes Y1 to Yn. Accordingly, the plasma panel displays the data.

Generation of X electrode driving signals 220 and Y electrode driving signals 230 by controller 200 will be described with reference to FIGS. 5 to 7.

The programming type address operation aims at generating a wall charge structure for a sustain discharge, which is accomplished by applying a low voltage to the scan electrode and a high voltage to the address electrode so that an address discharge is generated while continuing to maintain having the high voltage applied to the sustain electrode.

When a discharge is generated between the address electrode and the scan electrode, electrons accelerate towards the sustain electrode because the sustain electrode maintains the high voltage. When the voltage between the sustain electrode and the scan electrode has a value near the discharge firing voltage, a discharge may occur between the scan electrode and the sustain electrode. That is, the address discharge occurs between the address electrode and the scan electrode and between the scan electrode and the sustain electrode.

The address discharge may be weakened when the discharge fails to be generated between the scan electrode and the sustain electrode. When the discharge between the scan electrode and the sustain electrode is eliminated or substantially weakened, the wall voltage between the two electrodes formed by the address discharge becomes relatively low.

Therefore, when the reset operation is directly performed without performing a sustain discharge in the address operation of the subfield which represents the minimum unit of light, the wall voltage between the scan electrode and the sustain electrode may become an unimportant factor. In addition, it is possible to modify the sustain discharge so that it resembles the reset operation, perform a weak discharge, and then perform the reset operation.

When the discharge between the scan electrode and the sustain electrode is suppressed in the process of performing the address discharge, part of the discharge configuring the address discharge is weakened, the light caused by the address discharge is reduced, and the minimum unit of light is reduced.

The above-described weakened address discharge is applicable to the subfields that represent the minimum unit of light, or is applicable to all the subfields by performing the weakened address discharge and applying a method for normally performing a discharge in the sustain discharge.

In the first exemplary embodiment, a spatial voltage less than the conventional discharge firing voltage is effectively applied between the scan electrode and the sustain electrode during the address period to suppress the discharge between the scan electrode and the sustain electrode in the address discharge.

Figure 5:
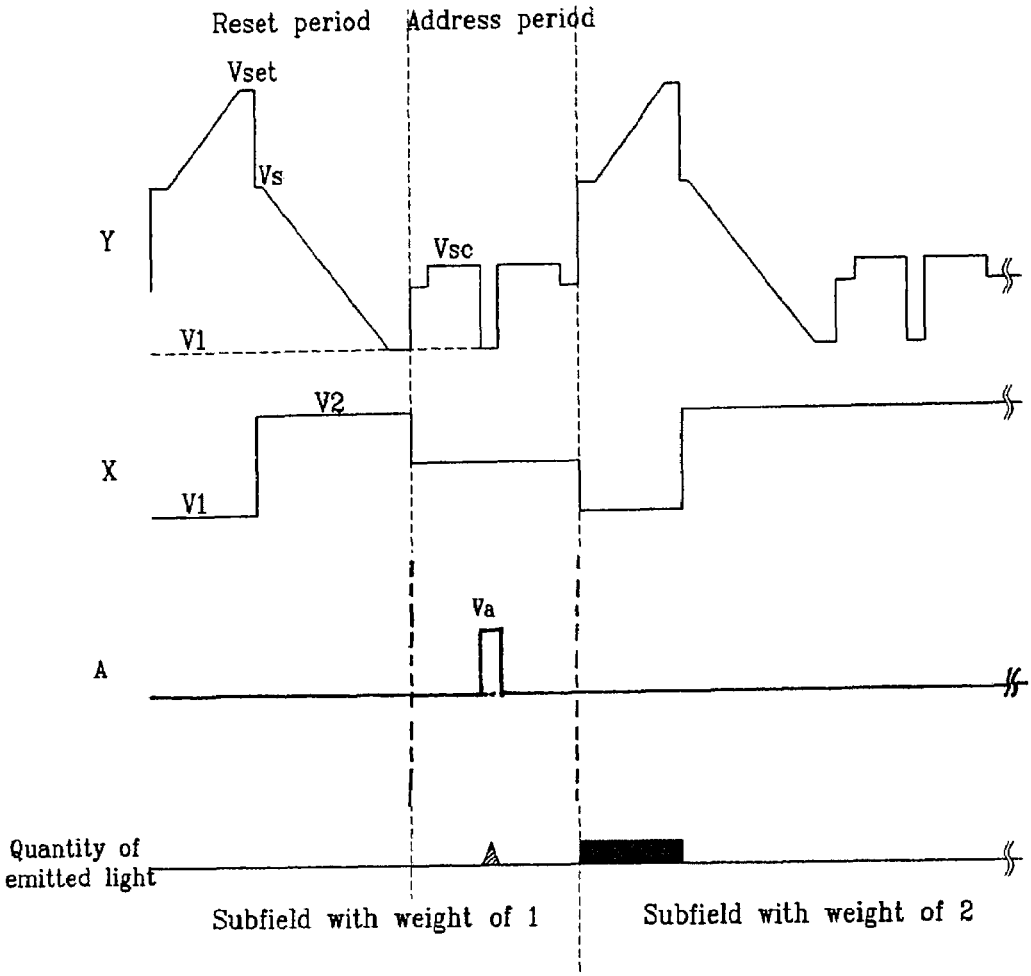
FIG. 5 shows a PDP driving waveform and amounts of light emitted in each subfield according to a first exemplary embodiment of the present invention.

FIG. 5 shows a PDP driving waveform and amounts of light emitted in each subfield according to a first exemplary embodiment of the present invention. The first subfield (a subfield with a weight of 1) includes a reset period and an address period, the second subfield (a subfield with a weight of 2) includes a reset period, an address period, and a sustain period, and other subfields include a reset period, an address period, and a sustain period, which apply the conventional waveforms.

As shown in FIG. 5, the driving waveform according to the first exemplary embodiment applies low voltage V1 to the sustain electrode while the voltage at the scan electrode gradually rises to voltage Vset during the reset period of the first subfield (the subfield with a weight of 1). As a result, a discharge is generated between the scan electrode and the sustain electrode.

A reset waveform that gradually reduces the voltage at the scan electrode is applied while high voltage V2 is applied to the sustain electrode. By the reset operation, the wall charge state of the previous sustain discharge is erased, and the wall charges for stably performing a next address discharge is set up.

A voltage lower by a predetermined amount than voltage V2 is applied to the sustain electrode during the address period.

The voltage becomes lower than the internal voltage formed during the reset period between the scan electrode and the sustain electrode, and hence the discharge or the current flow between the scan electrode and the sustain electrode is minimized.

The address voltage is applied to the address electrode of the cell to be selected when the scan electrodes are scanned so as to select the discharge cell.

The reset period of the subfield with the weight of 2 is started after the address period, and the reset waveform corresponds to the reset waveform of the subfield with the weight of 1.

Since the subfield with the weight of 2 has the same conventional waveform, the light of the subfield with the weight of 2 is represented by the address light, the sustain light, and the light of the reset period.

The subfields with weights of 3, 4, 5, etc. are produced by applying the sustain voltage during the sustain period according to the same method applied to the subfield with the weight of 2.

In this instance, the address light can be used as the minimum unit of light (i.e., the light which represents the minimum weight) since the reset light is less than the address light. The representation performance of the low gray scales can then be improved by reducing the brightness level of the minimum unit of light.

It is desirable to apply the above-noted waveform to the subfield that represents the minimum unit of light rather than to the conventional subfields.

Figure 6:
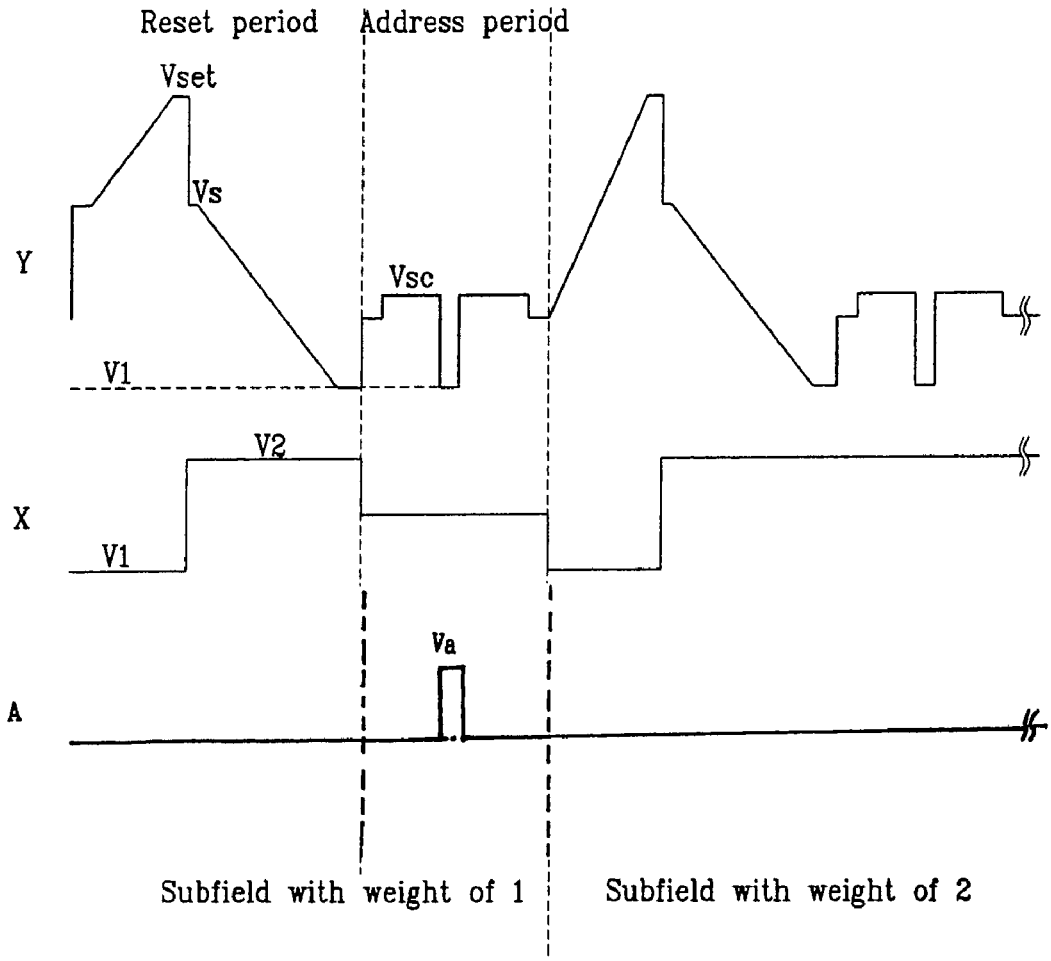
FIG. 6 shows a PDP driving waveform according to a second exemplary embodiment of the present invention.

FIG. 6 shows a PDP driving waveform according to a second exemplary embodiment of the present invention. The PDP driving waveform according to the second exemplary embodiment corresponds to the driving waveform of the first exemplary embodiment in the case of the subfield with the weight of 1, and has a different reset waveform in the case of the subfield with the weight of 2.

A ramp waveform which gradually rises to final reset voltage Vset from low level voltage Vsc of the sustain discharge voltage is applied to scan electrode Y during the reset period of the subfield with the weight of 2, and accordingly, a weak discharge (the reset light) is generated between the scan electrode Y and the sustain electrode X after a predetermined period. The reset light is weaker than the reset light of the subfield with the weight of 1.

The waveforms starting from the subfield with the weight of 3 correspond to the conventional waveforms, and hence, the light of the subfield with the weight of 2 or 3 is represented by the address light, the sustain light, and the light of the reset period.

The subfields with weights of 3, 4, 5, etc. are produced through the application of sustain voltage, during the sustain period and according to the same method applied to the subfield with the weight of 2.

Figure 7:
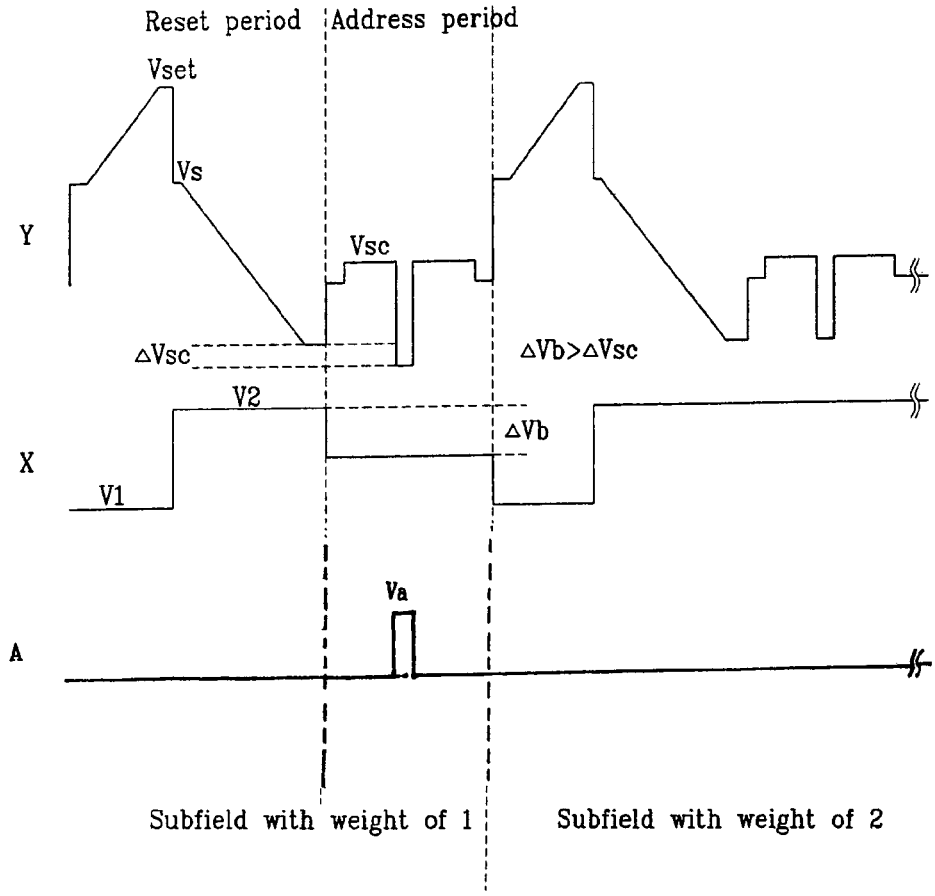
FIG. 7 shows a PDP driving waveform according to a third exemplary embodiment of the present invention.

FIG. 7 shows a PDP driving waveform according to a third exemplary embodiment of the present invention. The PDP driving waveform according to the third exemplary embodiment shows a case in which the voltage at the scan electrode is gradually reduced to a voltage greater than the voltage of the scan waveform.

In this instance, it is desirable that the difference between the voltage at the sustain electrode and voltage V2 is greater than the difference between the voltage which is finally reached by the voltage at the scan electrode through gradual reduction of voltage and the voltage of the scan waveform. Further, the bias voltage at the sustain electrode of the subfield which outputs the minimum unit of light during the address period is 0V, or less than voltage V2, and may share power used for other waveforms.

The subfield with the minimum weight according to the first to third exemplary embodiments corresponds to the subfield with the minimum weight from among the subfields applied when the load of the input image data is large, that is, when the image load ratio is high and the auto power control (APC) level is high.

The waveform that gradually rises to the reset voltage after the address period of the first subfield is given as the ramp waveform, which includes an RC waveform, a step waveform which varies a predetermined voltage and maintains the voltage for a predetermined time, and a floating waveform which repeatedly varies a predetermined voltage and floats the scan electrode Y at least once.

Also, the diagrams of the quantity of the emitted light is illustrated with a solid line in FIG. 5. Further, the quantity of the emitted light may also have other formats. The weight of the first subfield has been given as the weight of 1, which is the minimum weight for ease of description. However the weight may include various minimum weights such as 0.5 and 0.25.

While this invention has been described in connection with what is presently considered to be practical exemplary embodiments it is to be understood that the invention is not limited to the disclosed embodiments, but, on the contrary, is intended to cover various modifications and equivalent arrangements included within the spirit and scope of the appended claims.

As described above, the minimum unit of light is reduced by applying during the address period a voltage less than the discharge firing voltage of the subfield of the minimum weight and improving the representation performance of low gray scales.

What is claimed is:

1. A plasma display device for receiving external image data, and displaying the image data during a plurality of subfields, each of the subfields comprising at least a reset period and an address period, the plasma display device comprising:

a plasma panel including a plurality of address electrodes, scan electrodes, sustain electrodes and discharge cells;

a controller for receiving the image data and generating and outputting scan electrode driving signals, sustain electrode driving signals, and address electrode driving signals, the sustain electrode driving signals being set so that a potential of the sustain electrodes becomes less than a first voltage applied during the reset period by a predefined voltage during the address period of a subfield with a minimum weight from among the plurality of subfields;

an address data driver for applying a voltage corresponding to the address electrode driving signals to the address electrodes for selecting discharge cells to be discharged from among the discharge cells;

a sustain electrode driver for applying a voltage corresponding to the sustain electrode driving signals to the sustain electrodes; and a scan electrode driver for applying a voltage corresponding to the scan electrode driving signals to the scan electrodes.

2. The plasma display device of claim 1, wherein a constant voltage is established so that a potential difference between one of the scan electrodes and one of the sustain electrodes that are adjacent each other becomes less than a discharge firing voltage during the address period.

3. The plasma display device of claim 1, wherein the controller applies a constant voltage which is greater than a difference between a voltage reached by a reset waveform through gradual reduction of voltage and a scan voltage when the scan voltage applied to the scan electrodes in the address period is less than the voltage reached by the reset waveform through gradual reduction of voltage in the reset period.

4. The plasma display device of claim 1, wherein the controller applies a ramp waveform which gradually rises to a final reset voltage from a low level voltage of a sustain discharge voltage to the scan electrodes during the reset period of a subfield next to the subfield with the minimum weight from among the plurality of subfields.

5. A plasma display device for displaying an image during a plurality of subfields, each of the subfields comprising at least a reset period and an address period, the plasma display device comprising:

a first substrate;

a plurality of first electrodes and second electrodes in parallel on the first substrate;

a second substrate facing the first substrate with a gap therebetween;

a plurality of discharge cells in the gap each of the discharge cells corresponding to one of the first electrodes and one of the second electrodes;

a plurality of third electrodes on the second substrate for selecting discharge cells to be discharged from among the plurality of discharge cells, the third electrodes crossing the first electrodes and the second electrodes; and a driving circuit for supplying driving voltages to the first electrodes, the second electrodes, and the third electrodes so as to address and discharge the discharge cells, wherein:

the driving circuit respectively applies a first voltage and a second voltage to the first electrodes and the second electrodes corresponding to discharge cells to be selected from among the plurality of discharge cells during the address period of a subfield with a minimum weight from among the plurality of subfields, and a difference between the first voltage and the second voltage is less than a discharge firing voltage.

6. The plasma display device of claim 5, wherein subfields other than the subfield with the minimum weight from among the plurality of subfields further comprise a sustain period.

7. The plasma display device of claim 6, wherein a ramp waveform which gradually rises to a final reset voltage from a low level voltage of a sustain discharge voltage is applied to the scan electrodes during the reset period of a subfield next to the subfield with the minimum weight from among the plurality of subfields.

8. The plasma display device of claim 5, wherein the first electrodes are scan electrodes, and the second electrodes are sustain electrodes.

9. The plasma display device of claim 8, wherein a constant voltage is applied to be greater than a difference between a voltage reached by a reset waveform through gradual reduction of voltage and a scan voltage when the scan voltage applied to the scan electrodes in the address period is less than the voltage reached by the reset waveform through gradual reduction of voltage in the reset period.

10. A plasma display device for displaying an image during a plurality of subfields, each of the subfields comprising at least a reset period and an address period, the plasma display device comprising:

a first substrate;

a plurality of first electrodes and second electrodes in parallel on the first substrate;

a second substrate facing the first substrate with a gap therebetween;

a plurality of discharge cells in the gap, each of the discharge cells corresponding to one of the first electrodes and one of the second electrodes;

a plurality of third electrodes on the second substrate for selecting discharge cells to be discharged from among the plurality of discharge cells, the third electrode crossing the first electrodes and the second electrodes; and a driving circuit for supplying driving voltages to the first electrodes, the second electrodes, and the third electrodes so as to address and discharge the discharge cells wherein the driving circuit respectively applies a first voltage and a second voltage to the first electrodes and the second electrodes corresponding to discharge cells to be selected from among the plurality of discharge cells during the address period of the plurality of subfields, and wherein a difference between the first voltage and the second voltage is less than a discharge firing voltage.

11. A method for driving a plasma display panel by using a plurality of subfields, the plasma display panel having a plurality of first electrodes and second electrodes in parallel on a first substrate, and a plurality of third electrodes on a second substrate and crossing the first and second electrodes, and discharge cells formed by the first, second, and third electrodes, the method comprising:

(a) applying a reset voltage to the first electrodes and the second electrodes to erase a wall charge state of a previous sustain discharge, and setting up the wall charges so as to stably perform a subsequent address discharge; and (b) applying a first voltage and a second voltage to the first electrodes and the second electrodes of the discharge cells to be selected from among the discharge cells, wherein a first light of a subfield with a minimum weight from among the plurality of subfields is represented by an address light without a sustain light.

12. The method of claim 11, further comprising (c) applying a voltage which gradually rises from a third voltage to a fourth voltage to the first electrodes, and generating a reset light that is less bright than the address light.

13. The method of claim 11, wherein (b) and (c) are performed during the subfield with the minimum weight.

14. The method of claim 11, wherein the first electrodes are scan electrodes, and the second electrodes are sustain electrodes.

15. The method of claim 14, wherein a constant voltage is applied to be greater than a difference between a voltage reached by a reset waveform through gradual reduction of voltage and a scan voltage when the scan voltage applied to the scan electrodes in an address period of the subfield with the minimum weight is less than the voltage reached by the reset waveform through gradual reduction of voltage in the reset period.

16. A method for dividing a frame into a plurality of subfields, and driving a plasma display panel during the plurality of subfields, the plasma display panel comprising a plurality of first electrodes and second electrodes in parallel on a first substrate, a plurality of third electrodes on a second substrate and crossing the first and second electrodes, and a plurality of discharge cells corresponding to the first electrodes, the second electrodes and the third electrodes, the method comprising:

applying a first voltage and a second voltage to the first electrodes and the second electrodes corresponding to discharge cells to be selected from among the plurality of discharge cells during an address period of a first subfield with a minimum weight from among the plurality of subfields, and wherein a difference between the first voltage and the second voltage is less than a discharge firing voltage.

17. The method of claim 16, further comprising applying a voltage which gradually rises to a fourth voltage from a third voltage to the first electrodes during a second subfield from among the plurality of subfields after the address period of the first subfield.

* * * * *

UNITED STATES PATENT AND TRADEMARK OFFICE

CERTIFICATE OF CORRECTION

PATENT NO. : 7,576,710 B2
APPLICATION NO. : 10/969346
DATED : August 18, 2009
INVENTOR(S) : Jin-Sung Kim et al.

It is certified that error appears in the above-identified patent and that said Letters Patent is hereby corrected as shown below:

In the Claims

| | |
|---|---|
| Column 8, Claim 5, line 10 | Insert -- , -- after "gap" |
| Column 8, Claim 10, line 63 | Delete "electrode" Insert -- electrodes -- |
| Column 8, Claim 10, line 67 | Insert -- , -- after "cells" |

Signed and Sealed this
Seventeenth Day of May, 2011

David J. Kappos

David J. Kappos
*Director of the United States Patent and Trademark Office*